US011607358B2

(12) United States Patent
Spahn et al.

(10) Patent No.: US 11,607,358 B2
(45) Date of Patent: Mar. 21, 2023

(54) PATIENT POSITIONING AND TURNING SHEET

(71) Applicant: EHOB, INc., Indianapolis, IN (US)

(72) Inventors: James G. Spahn, Carmel, IN (US); Tyler K. Oehlman, McCordsville, IN (US); Aaron D. Kadel, Indianapolis, IN (US); Gregory R. Konkle, Indianapolis, IN (US); Alex Opell, Indianapolis, IN (US); Joshua Richard, Danville, IN (US)

(73) Assignee: EHOB, Inc., Indianapolis, IN (US)

( * ) Notice: Subject to any disclaimer, the term of this patent is extended or adjusted under 35 U.S.C. 154(b) by 98 days.

(21) Appl. No.: 17/155,752

(22) Filed: Jan. 22, 2021

(65) Prior Publication Data

US 2021/0228428 A1 Jul. 29, 2021

Related U.S. Application Data

(60) Provisional application No. 62/964,704, filed on Jan. 23, 2020.

(51) Int. Cl.
*A61G 7/10* (2006.01)
*A61G 7/00* (2006.01)

(52) U.S. Cl.
CPC ..... *A61G 7/1026* (2013.01); *A61G 7/001* (2013.01); *A61G 2200/32* (2013.01)

(58) Field of Classification Search
CPC ... A61G 7/001; A61G 7/1026; A61G 2200/32
See application file for complete search history.

(56) References Cited

U.S. PATENT DOCUMENTS

| | | | | |
|---|---|---|---|---|
| 4,535,096 | A * | 8/1985 | Jacobs | C08J 9/0014 521/107 |
| 5,638,558 | A * | 6/1997 | Moore | A61G 7/1026 5/81.1 T |
| 10,576,004 | B1 * | 3/2020 | Frances | A47G 9/0238 |
| 2012/0186013 | A1 * | 7/2012 | Ponsi | A61G 7/001 5/81.1 R |
| 2017/0119608 | A1 * | 5/2017 | Rigoni | A61G 7/1051 |

* cited by examiner

*Primary Examiner* — David R Hare
*Assistant Examiner* — Adam C Ortiz
(74) *Attorney, Agent, or Firm* — Maginot, Moore & Beck, LLP

(57) ABSTRACT

A patient turning sheet includes a flexible rectangular bottom sheet that has a surface area sized to support the majority of the body of a person lying on the patient turning sheet. A flexible rectangular top sheet is sewn to the bottom sheet and has a surface area less than the surface area of the bottom sheet. The top sheet is sewn to the bottom sheet, offset toward the head end of the turning sheet to be positioned at the area of maximum contact and load of the patient on the turning sheet. A foam pad is disposed between the bottom sheet and the top sheet that is relatively less flexible than the bottom or top sheets.

17 Claims, 1 Drawing Sheet

SECTION VIEW A-A

PATIENT POSITIONING AND TURNING SHEET

PRIORITY CLAIM

This application is a utility filing from and claims priority to U.S. Provisional Application No. 62/964,704, filed on Jan. 23, 2020, the entire disclosure of which is incorporated herein by reference.

BACKGROUND

The present disclosure relates to devices facilitating the turning or repositioning of bedridden patients by caregivers. In particular, the disclosure relates to a sheet used as a turning or positioning device.

Without periodic turning or other repositioning relative to a support surface, a bedridden patient can develop pressure ulcers. Pressure ulcers (also known as pressure sores, bed sores, or decubitus ulcers) represent localized areas of tissue damage. Pressure ulcers often occur when the soft tissue between a bony prominence and an external surface is compressed for an extended period of time. Pressure ulcers can also occur from friction, such as by rubbing against a bed, cast, brace, or the like. Pressure ulcers commonly occur in immobilized patients who are confined to a bed, chair or wheelchair. Localized tissue ulceration results when pressure on the skin exceeds capillary filling pressure (approximately 32 mm Hg), which thereby impedes the microcirculation in the skin and the underlying subcutaneous tissue. With compromised blood flow, the delivery of oxygen and nutrients to target tissues is impaired. If blood flow is not restored promptly, the skin and subcutaneous tissue will die and a pressure ulcer will develop. Pressure ulcers can start to develop after only 20-30 minutes of immobility and pressure loading, but the effects can be resolved by turning the patient away from the particular pressure loading within an established period.

Therefore, periodic turning of a patient is routinely performed by caregivers to prevent the occurrence or lessen the severity of pressure ulcers in the patent. Typically, patient turning is performed every two hours according to a "q2 protocol", a turning regimen well-known in the relevant art. The q2 protocol is a long-standing rule of practice that requires observing, turning, assessing and attending the patient every two hours. The observing, assessing and attending steps concern looking for symptoms of a developing pressure ulcer and treating the condition. The turning step involves physically moving the patient to a different position to relieve the pressure on the particular location. Accordingly, a patient may, for example, be moved from a first orientation flat on his/her back, to a second orientation in which his/her body is substantially oblique to the support surface i.e., on his/her side. In the second orientation, the patient's body is often supported by a devices, such as foam wedge members, interposed between the patient and the support surface. In subsequent repositionings, the patent will be oriented in a variety of positions to manage the pressure applied to the patient's body over what might be a lengthy time in bed. Again, the conventional protocol is to reposition every patient every two hours, day and night.

The risks to the bed-ridden patient of non-compliance with the q2 protocol can be significant. It can be appreciated that pressure ulcer prevention presents a significant workload for the nursing or caregiver staff. In addition to the time demands of maintaining the q2 protocol 2-hour schedule, repositioning a patient, particularly patients who are unable to assist, can be physically demanding. Safe Patient Handling ("SPH") standards have been developed that concern the occupational health and safety of nurses and caregivers with respect to the handling of patients, which includes the turning, repositioning, transference, or otherwise moving or supporting patients bodily. Objectives of SPH include preventing injuries to caregivers due, for example, to muscle strain, and facilitating greater ease in handling their patients.

Therefore, positioning devices are commonly used to facilitate SPH of bedridden patients. Types of positioning devices relevant to this disclosure include devices comprising a glide sheet having an upper or top side surface on which the patient lays, and an opposite, lower or bottom side surface that contacts a support surface, such as a bed mattress, support wedge(s), and/or mattress-covering sheet. The bottom side surfaces are configured to facilitate sliding movement of the glide sheet and the patient, relative to the support surface(s), by the caregiver(s) pulling the glide sheet.

In some prior positioning devices, the glide sheet top side material layer is typically polyester, and the bottom side material layer is typically polyester or rip-stop nylon, both of which are moisture permeable and breathable fabrics. The polyester top side material layer also provides some moisture wicking properties. Such prior positioning devices ordinarily facilitate convective airflow and heat transfer therethrough, particularly when the patient is obliquely positioned and supported by wedges as described above, which creates between the patient and the mattress an air space receivable of heat, air and/or moisture from the glide sheet.

In certain prior positioning devices, the patient directly interfaces the top side surface of the glide sheet. Such positioning devices are wholly disposable, and intended to be replaced when soiled or wetted, as by perspiration or incontinence. Certain other prior positioning devices include replaceable moisture-absorbent pads that are removably secured to the top side surface of the glide sheet. In these devices, the glide sheets may be used indefinitely, whereas the pads are disposable.

SUMMARY OF THE DISCLOSURE

A patient turning sheet is provided that comprises a flexible bottom sheet having a bottom surface with a static coefficient of friction adapted to slide on a fabric surface. The bottom sheet is generally rectangular and has a surface area sized to support the majority of the body of a person lying on the patient turning sheet. The turning sheet further includes a flexible top sheet having a top surface adapted to support a person lying thereon. The top sheet is generally rectangular with a surface area less than the surface area of the bottom sheet. The top sheet is sewn to the bottom sheet offset toward the head end of the turning sheet and in alignment with the portion of the person's body that has the maximum contact and generates the maximum pressure on the turning sheet.

In one feature of the present disclosure, the turning sheet includes a foam pad disposed between the bottom sheet and the top sheet. The foam pad is relatively less flexible than the bottom sheet and the top sheet. In some embodiments, the foam pad is porous and compressible.

DETAILED DESCRIPTION

Figure 2:
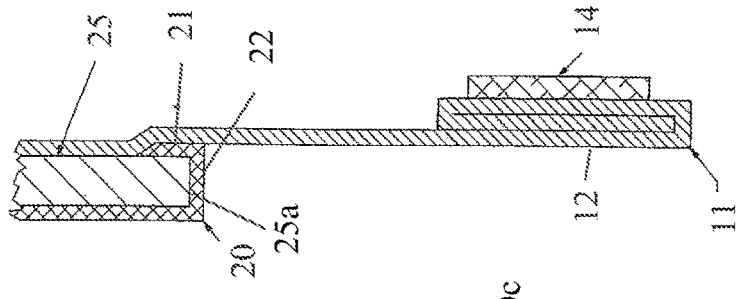
FIG. 2 is an end cross-sectional view of the turning sheet shown in FIG. 1, taken along line A-A.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Figure 1:
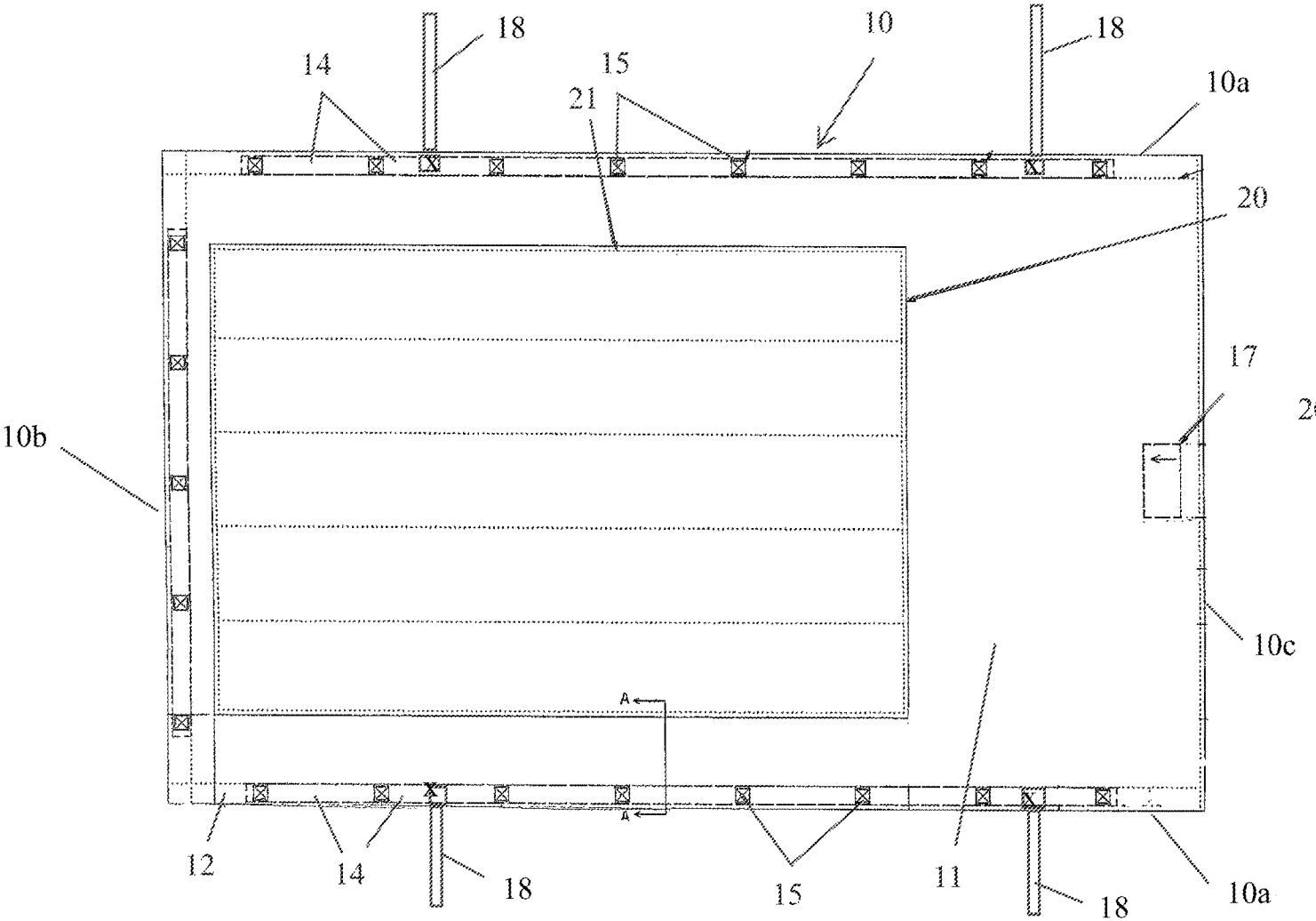
FIG. 1 is a top view of a positioning and turning sheet according to the present disclosure.

A turning sheet 10, shown in FIG. 1, includes a bottom sheet 11 that is formed of a material with a low static coefficient of friction to facilitate movement of the sheet and a patient lying on the sheet. The bottom sheet 11 is configured and has a surface area sized to support the majority of the body of the person resting on the hospital bed, in particular at least from the neck to the upper thighs of a patient. Thus, in one embodiment, the sheet 11 has a length of about 56 inches and a width of 35.5 inches. In one specific embodiment, the bottom sheet 11 is formed of rip-stop nylon, with a bottom surface having a static coefficient of friction of 0.10-0.15 on typical hospital bedding. This material is strong and tear-resistant. Moreover, the nylon sheet can be readily cleaned of bodily fluids, such as sweat and urine, allowing re-use of the turning sheet 10. The bottom sheet 11 is provided with a sewn hem 12 around three legs of the perimeter, namely the opposite long sides 10*a* and the head end 10*b* of the sheet. As shown in the cross-sectional view of FIG. 2, the bottom sheet is folded over on itself at the hem 12 to increase the thickness of the sheet 11 at the perimeter that is to be engaged by the nurse or caregiver when repositioning or turning a patient. In one embodiment, the bottom sheet is folded over twice so that three layers of the sheet are sewn together to form the hem 12.

The perimeter hem 12 also serves as a foundation for handles 14 sewn onto the sheet. The handles 14 are formed from a single strap, such as nylon webbing, that is sewn to the bottom sheet 11 at periodic box stitches 15. In the illustrated embodiment, the box stitches 15 are spaced apart at about 6.5 inch intervals to form a handle that can be easily and comfortably grasped by the nurse or caregiver. In a specific embodiment, the box stitches can be formed of a prominently colored thread, such as orange, that visually stands out against the background color of the bottom sheet, such as green. The high-visibility color allows the caregiver to quickly find the handles 14. In addition to the handles, the positioning sheet can optionally include lateral straps 18 extending outwardly from the sides of the bottom sheet, as shown in FIG. 1. The straps can be sewn to the hem 12 by box stitches, similar to the stitches used to form the handles 14. In another feature, the foot end 10*c* of the bottom sheet is provided with a head-side indicia 17, which can be a panel sewn onto the bottom sheet with text identifying the product or the foot-end of the sheet.

As discussed above, the typical positioning and turning sheet includes a top sheet with a top surface having a greater static coefficient of friction than the bottom sheet to prevent the patient from slipping or sliding on the positioning sheet 10. The greater coefficient of friction also prevents slipping of a positioning wedge placed on the top sheet to support the patient at a desirable angle. The positioning sheet 10 thus includes a top sheet 20 that is sewn to the top surface of the bottom sheet around the perimeter of the top sheet by perimeter stitching 21. The top sheet can be a tricot polyester mesh that is comfortable to the patient while providing a desirable coefficient of friction that can be at least twice, and preferably four times greater than the coefficient for the bottom sheet. As shown in FIG. 1, the top sheet 20 is not co-extensive with the bottom sheet 11. The top sheet 20 is the portion that is always in direct contact with the patient. The top sheet is thus sized and arranged to cover the areas of maximum patient contact and mass, such as the patient's body between the upper back and the upper thighs. In the example shown in FIG. 1, the bottom sheet 11 has a length of about 56 inches and a width of 35.5 inches. On the other hand, the top sheet 20 has a length of 37.5 inches and a width of 25.5 inches. Thus, in certain embodiments, the surface area of the top sheet 20 is 40-70% of the surface area of the bottom sheet 11. Moreover, as shown in the figure, the top sheet is offset toward the head-end 10*b* of the bottom sheet, leaving a margin of about 2.5 inches at the head-end 10*b* and a much larger margin of about 16 inches at the foot-end 10*c*. This feature of the positioning sheet 10 reduces the overall mass of the sheet and increases the area of the readily wipe-able or cleanable nylon surface. This feature also increases the area of the visually more pleasing color of the bottom sheet, green in the specific example, which is visible even when the patient is lying on the sheet 10.

One problem associated with prior positioning and turning sheets is that the flexibility of the sheet causes it to bunch up or wrinkle when the patient is placed on and moved with the sheet. This bunching and wrinkling can itself be an origin site for discomfort to the patient and even bed sores. The bunching also compromises the ability of the prior sheet to contain bodily fluids by creating channels for fluid leakage. Bunching and wrinkling can also make placing the sheet underneath a patient more difficult as it bunches against the patient's body. In order to overcome this problem with prior turning sheets, the positioning and turning sheet 10 of the present disclosure incorporates a foam pad 25 between the top sheet 20 and bottom sheet 11. As shown in the cross-sectional view of FIG. 2, the foam pad 25 is sewn into the top sheet with a portion 22 of the top sheet folded around the perimeter side 25*a* of the pad and stitching 21 underneath the pad at the bottom sheet side of the interface. In one specific embodiment, the stitching 21 is arranged about 0.25 inches from the edge of the top sheet 20 so that the top sheet originates underneath the foam pad 25 and includes the portion 22 that wraps around the perimeter side 25*a* of the pad as shown in FIG. 2.

In one feature of the positioning sheet 10 disclosed herein, the foam pad 25 is formed of polyurethane with a thickness of 0.1-0.2 inches, and preferably of about 0.125 inches. The top sheet 20 is sewn tightly around the pad 25 to retain the pad in position. The pad adds rigidity to the positioning and turning sheet 10 to prevent any bunching or wrinkling of the sheet in use. The addition of the foam pad makes it easier to place the sheet underneath a patient because the sheet will not wrinkle or bunch. The foam pad also facilitates moving the patient with the sheet, again because the rigidity of the pad prevents bunching as the sheet is moved. The pad can also be porous to help dissipate heat from the patient, which therefore reduces an aggravating factor in the formation of pressure ulcers. The pad can be formed of a foam material that provides the shear rigidity necessary to prevent bunching and wrinkling, while providing some compressibility to allow the positioning and turning sheet 10 to slightly envelop the patient's body. This small amount of patient immersion into the sheet can help stabilize the position of the patient and potentially enlarge the area of contact to help deter the onset of pressure ulcers.

The present disclosure should be considered as illustrative and not restrictive in character. It is understood that only certain embodiments have been presented and that all changes, modifications and further applications that come within the spirit of the disclosure are desired to be protected.

What is claimed is:

1. A patient turning sheet comprising: a flexible bottom sheet having a bottom surface with a static coefficient of friction adapted to slide on a fabric surface, the bottom sheet being generally rectangular and having a surface area sized to support the majority of the body of a person lying on the patient turning sheet; a flexible top sheet being generally having a rectangular perimeter and having a top surface adapted to support a person lying thereon, the top sheet affixed to the bottom sheet around said rectangular perimeter, the top sheet having a static coefficient of friction greater than the static coefficient of friction of said bottom sheet; and a foam pad disposed between the bottom sheet and the top sheet entirely inside said perimeter, the foam pad being relatively less flexible than the bottom sheet and the top sheet; wherein: the patient turning sheet further includes a foot end for placement adjacent the feet of the person and an opposite head end for placement adjacent the head of the person; and the upper sheet is positioned on the lower sheet closer to said head end than said foot end.

2. The patient turning sheet of claim 1, wherein said top surface of said top sheet has a surface area less than the surface area of the bottom sheet.

3. The patient turning sheet of claim 2, wherein said bottom sheet has a length of about 56 inches and a width of about 35.5 inches; and said top sheet has a length of about 37.5 inches and a width of about 25.5 inches.

4. The patient turning sheet of claim 1, wherein said top surface of said top sheet has a static coefficient of friction at least two times greater than the static coefficient of the bottom surface of the bottom sheet.

5. The patient turning sheet of claim 1, wherein said foam pad is a polyurethane with a thickness of 0.1-0.2 inches.

6. The patient turning sheet of claim 5, wherein said pad is porous.

7. The patient turning sheet of claim 3, wherein said pad is compressible.

8. The patient turning sheet of claim 1, wherein said bottom sheet is formed of a rip-stop nylon.

9. The patient turning sheet of claim 1, wherein said top sheet is formed of a tricot polyester mesh.

10. The patient turning sheet of claim 1, wherein the top sheet includes a portion that is folded around a perimeter side of the pad and that is sewn to the bottom sheet by perimeter stitching between the pad and the upper surface of the bottom sheet.

11. The patient turning sheet of claim 1, further comprising an indicia on said bottom sheet at said foot end.

12. The patient turning sheet of claim 1, wherein said upper sheet is positioned on said bottom sheet to define side margins between side edges of said upper sheet and side edges of said bottom sheet, a foot-end margin between end edges of said upper sheet and said bottom sheet oriented at said foot end of said turning sheet, and a head-end margin between end edges of said upper sheet and said bottom sheet oriented at said head end of said turning sheet, wherein said foot end margin is greater than said head-end margin.

13. The patient turning sheet of claim 12, wherein said head-end margin is margin of about 2.5 inches and said foot-end margin is about 16 inches.

14. The patient turning sheet of claim 1, wherein the bottom sheet includes a sewn hem along an end of the bottom sheet at said head end head end of said turning sheet and along opposite sides of said bottom sheet extending from said end of the bottom sheet, said bottom sheet folded over on itself at said sewn hem so that said hem has a thickness greater than the thickness of said bottom sheet inside said hem.

15. The patient turning sheet of claim 1, further comprising an elongated strap sewn to said bottom sheet at spaced apart locations along each of the opposite sides of said bottom sheet, said elongated strap defining hand-holds for manually grasping to move the patient turning sheet with a person thereon.

16. The patient turning sheet of claim 15, wherein said elongated strap is formed of a material with a different color than the material of the bottom sheet.

17. The patient turning sheet of claim 15, wherein said elongated strap is a nylon web.

* * * * *